US007830340B2

(12) United States Patent
Umezaki

(10) Patent No.: US 7,830,340 B2
(45) Date of Patent: Nov. 9, 2010

(54) DISPLAY DEVICE AND DRIVING METHOD THEREOF, DISPLAY MODULE, AND PORTABLE INFORMATION TERMINAL

(75) Inventor: Atsushi Umezaki, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1234 days.

(21) Appl. No.: 11/287,472

(22) Filed: Nov. 28, 2005

(65) Prior Publication Data

US 2006/0164347 A1 Jul. 27, 2006

(30) Foreign Application Priority Data

Dec. 1, 2004 (JP) ..... 2004-348697

(51) Int. Cl.
*G09G 3/30* (2006.01)

(52) U.S. Cl. ..... 345/76; 345/82; 315/169.3

(58) Field of Classification Search ..... 345/76, 345/82, 204, 45, 46, 87, 90, 211, 214; 349/143, 349/149; 257/59, 72; 315/169.3; 313/500, 313/506

See application file for complete search history.

(56) References Cited

U.S. PATENT DOCUMENTS 6,859,193 B1 2/2005 Yumoto
7,317,435 B2 * 1/2008 Hsueh ..... 345/82
2003/0090481 A1 * 5/2003 Kimura ..... 345/211
2003/0128200 A1 7/2003 Yumoto
2004/0207615 A1 10/2004 Yumoto
2005/0190177 A1 9/2005 Yumoto
2005/0200300 A1 9/2005 Yumoto
2007/0210720 A1 9/2007 Kimura

FOREIGN PATENT DOCUMENTS

CN 1419228 5/2003
EP 1 310 937 5/2003
WO WO 01/06484 A1 1/2001
WO WO 02/39420 A1 5/2002

OTHER PUBLICATIONS

Chinese Office Action (Chinese Application No. 200510128827), 20 pages, mailed Jun. 6, 2008 with English translation.

* cited by examiner

*Primary Examiner*—Abbas I Abdulselam
(74) *Attorney, Agent, or Firm*—Fish & Richardson P.C.

(57) ABSTRACT

It is an object to provide a display device having a simple structure of a driver circuit for inputting a video signal to a pixel, high display quality of the intermediate gradation and low power consumption, and a driving method thereof.

Each of a plurality of pixels has a light emitting element and a capacitor. One electrode of the light emitting element is connected to the other electrode of the capacitor and one electrode of the light emitting element is applied to a voltage which is equal to or higher than a threshold voltage of the light emitting element and a potential of one electrode of the capacitor is changed. Therefore, a potential of one electrode of the light emitting element is changed and the light emitting element emits light.

18 Claims, 9 Drawing Sheets

DISPLAY DEVICE AND DRIVING METHOD THEREOF, DISPLAY MODULE, AND PORTABLE INFORMATION TERMINAL

TECHNICAL FIELD

The present invention relates to an active matrix type display device and driving method thereof. The invention specifically relates to a display device having a light emitting element and a switching element such as a thin film transistor (hereinafter referred to as a TFT) in each pixel, and a driving method thereof. Further, the invention relates to an electronic apparatus using a display device and a driving method thereof.

BACKGROUND ART

In recent years, a technique for forming a TFT has greatly improved and application development to an active matrix type display device has been advanced. Specifically, a TFT using a polysilicon film for an active layer has higher field effect mobility (also referred to as mobility) than a conventional TFT using an amorphous silicon film, thereby high speed operation is possible. Therefore, a driver circuit formed using a TFT over the same substrate as a substrate over which pixels are formed can control the pixels. In a display device having various circuits formed using a TFT over the same substrate as the substrate over which pixels are formed, various advantages can be obtained such as reducing manufacturing cost, downsizing, rising yield, and reducing throughput.

Research of an active matrix type EL display device having an electroluminescent element which is a light emitting element (hereinafter referred to as an EL element) as a display element in each pixel of a display device has been activated. The EL display device is also called an organic EL display (OELD: Organic EL Display) or an organic light emitting diode (OLED: Organic Light Emitting Diode).

Generally, a current value flowing to an EL element is proportionally related to a light emission luminance of an EL element, thereby in an EL display device using an El element as a display element, luminescence is controlled by the current value. Therefore, in the EL display device, proposed has been a pixel configuration which is different from a liquid crystal display device which controls luminance by a voltage value (see Patent Document 1).

Further, proposed has been a driver circuit for inputting a video signal to each pixel of an EL display device as described in Patent Document 1 (Patent Document 2).

[Patent Document 1]

International Publication No. WO 01/06484 pamphlet

[Patent Document 2]

International Publication No. WO 02/39420 pamphlet

DISCLOSURE OF INVENTION

Problems to be Solved by the Invention

The invention described in the aforementioned Patent Document 1 uses a driving method in which a current value proportional to a gradation is inputted to each pixel as a video signal to determine a current value flowing to an EL element of each pixel. However, in this driving method, as shown in the aforementioned Patent Document 2, a driver circuit for inputting a video signal to a pixel is required a structure having many current sources in order to output a current of analog current value. Therefore, a structure of the driver circuit is complicated. Further, an input of a video signal to a pixel tends to be that an input of a video signal of an intermediate gradation close to black becomes incomplete so that display quality of the intermediate gradation deteriorates. In addition, for controlling the current value of an EL element, a TFT connected to an EL element in series is operated in a saturation region, thereby power consumption of an EL display device increases to generate much heat.

In order to solve the aforementioned defects, the invention provides a display device having a simple structure of a driver circuit for inputting a video signal to a pixel, the high display quality of the intermediate gradation and low power consumption, and the driving method thereof.

Means for Solving the Problem

The invention has a plurality of pixels in which each of the plurality of pixels has a light emitting element interposed between a pair of electrodes and a capacitor for holding a voltage between a pair of electrodes, in which one of the pair of electrodes of the light emitting element is connected to the other electrode of the capacitor, and a voltage which is equal to or higher than a threshold voltage Vth of the light emitting element is applied to the one electrode of the light emitting element. Then, a potential of a node at which the one electrode of the light emitting element is connected to the other electrode of the capacitor becomes equal to the threshold voltage Vth to hold a voltage corresponding to the threshold voltage Vth of the light emitting element in the capacitor. Furthermore, one electrode of the capacitor is changed so that potential of the one electrode of the light emitting element becomes a potential summed the threshold voltage Vth and the amount of potential change Vg of the capacitor so that the light emitting element emits light. Fore example, a potential of the one electrode of the capacitor increases, thereby a potential of the electrode of the capacitor and a potential of the one electrode of the light emitting element increase only by the amount that the potential of the one electrode of the capacitor increases. Thus, the light emitting element emits light.

That is, a structure of the invention has a plurality of pixels in which each of the plurality of pixels has a light emitting element interposed between a pair of electrodes and a capacitor for holding a voltage between a pair of electrodes, in which one electrode of the light emitting element is connected to the other electrode of the capacitor, and a voltage which is equal to or higher than a threshold voltage Vth of the light emitting element is applied to the one electrode of the light emitting element to change a potential of one electrode of the capacitor, and a potential of the one electrode of the light emitting element is changed so that the light emitting element emits light.

The aforementioned structure can be applied in the case without considering a voltage which is capacity-divided by the capacitor and the light emitting element. Note that in the case of considering, in a potential of a node (that is, the one electrode of the light emitting element) at which the one electrode of the light emitting element is connected to the other electrode of the capacitor, the amount of potential change Vg in the one electrode of the capacitor is increased by a voltage which is capacity-divided by the capacitor and the light emitting element. That is, the potential of the one electrode of the light emitting element becomes (capacitance C of a capacitor/(capacitance C of the capacitor+capacitance Cel of a light emitting element))×(the amount of potential change Vg in one electrode of the capacitor)+a threshold voltage Vth.

The threshold voltage Vth of the light emitting element is a voltage applied to the light emitting element when a current flows to the light emitting element to start emitting light. That is, the light emitting element emits light when a voltage which is equal to or higher than the threshold voltage Vth is applied.

The potential of one electrode of the capacitor (the amount of potential change Vg) may be controlled and the luminance of the light emitting element may be controlled to express a gradation of a display portion as well. Further, such as a digital time gradation, time when a light emitting element of each pixel emits light may be controlled and the luminance of the light emitting element may be controlled to express a gradation of a display portion as well.

Description is made on a structure of a display device displaying by the aforementioned driving method below.

(Structure 1)

The invention is a display device characterized in that a first wire, a second wire, a third wire, and a plurality of pixels are included, in which each of the plurality of pixels has a switching element, a capacitor having a pair of electrodes, and a light emitting element having a pair of electrodes; one electrode of the capacitor is connected to the first wire, and the other electrode of the capacitor is connected to one electrode of the light emitting element and the second wire through the switching element which is in an ON state, and an ON state or an OFF state of the switching element is controlled by a signal inputted to the third wire.

Note that in the aforementioned structure, a predetermined potential is given to the other electrode of the light emitting element.

(Structure 2)

The invention is a display device characterized in that a first wire, a second wire, a third wire, a fourth wire, a fifth wire, and a plurality of pixels are included, in which each of the plurality of pixels has a first switching element, a second switching element, a third switching element, a first capacitor having a pair of electrodes, a second capacitor having a pair of electrodes, and a light emitting element having a pair of electrodes; one electrode of the first capacitor is connected to the first wire, and the other electrode of the first capacitor is connected to the third wire through one electrode of the light emitting element and the first switching element which is in an ON state and the second switching element which is in an ON state sequentially, an electrode which controls an ON state or an OFF state of the second switching element is connected to the fourth wire through one electrode of the second capacitor and the third switching element which is in an ON state, an ON state or an OFF state of the first switching element is controlled by a signal inputted to the second wire, and an ON state or an OFF state of the third switching element is controlled by a signal inputted to the fifth wire.

Note that in the aforementioned structure, a structure can be made in which a predetermined potential is given to the other electrode of the light emitting element.

Further, the other electrode of the second capacitor may be connected anywhere as long as a constant potential is maintained when a operation of the second switching element. For example, the other electrode of the second capacitor may be connected to the other electrode of the light emitting element or may be connected to other wires.

(Structure 3)

A transistor can be used for the switching element of the Structure 1. Description is made on a structure of the case where a transistor is used for the switching element.

The invention is a display device characterized in that a first wire, a second wire, a third wire, and a plurality of pixels are included, in which each of the plurality of pixels has a transistor, a capacitor having a pair of electrodes, and a light emitting element having a pair of electrodes; one electrode of the capacitor is connected to the first wire, the other electrode of the capacitor is connected to one electrode of the light emitting element and one of the source or the drain of the transistor, the other of the source or the drain of the transistor is connected to the second wire, and the gate of the transistor is connected to the third wire.

Note that in the aforementioned structure, a structure can be made in which a predetermined potential is given to the other electrode of the light emitting element.

(Structure 4)

A transistor can be used for the switching element of the Structure 2. Description is made on a structure of the case where a transistor is used for the switching element.

The invention is a display device characterized in that a first wire, a second wire, a third wire, a fourth wire, a fifth wire, and a plurality of pixels are included, in which each of the plurality of pixels has a first transistor, a second transistor, a third transistor, a first capacitor having a pair of electrodes, a second capacitor having a pair of electrodes, and a light emitting element having a pair of electrodes; one electrode of the first capacitor is connected to the first wire, the other electrode of the first capacitor is connected to one of the source or the drain of the first transistor and one electrode of the light emitting element, the other of the source or the drain of the first transistor is connected to one of the source or the drain of the second transistor, the gate of the first transistor is connected to the second wire, the other of the source or the drain of the second transistor is connected to the third wire, the gate of the second transistor is connected to one of the source or the drain of the third transistor and one electrode of the second capacitor, the other of the source or the drain of the third transistor is connected to the fourth wire, and the gate of the third transistor is connected to the fifth wire.

Note that in the aforementioned structure, a structure can be made in which a predetermined potential is given to the other electrode of the light emitting element.

Further, the other electrode of the second capacitor may be connected anywhere as long as a constant potential is maintained when a operation of the second transistor. For example, the other electrode of the second capacitor may be connected to the other electrode of the light emitting element or may be connected to other wires.

Note that a voltage exceeding a threshold value is applied between the gate and the source of the transistor, thereby a state a current flows between the source and the drain, which is called that the transistor is in an ON state. Moreover, a voltage below a threshold value is applied between the gate and the source of the transistor; thereby a current does not flow between the source and the drain, which is called that the transistor is in an OFF state.

In the invention, to be connected is synonymous with to be electrically connected. Therefore, in the structure of the invention, in addition to a predetermined connection, other elements (for example, an element such as a switch, a transistor, a diode, or a capacitor) capable of electrically connecting therebetween may be arranged as well.

Although an example using a transistor as one example of a switching element in Structure 3 and Structure 4 is described, the invention is not limited thereto. As a switching element, an electrical switch or a mechanical switch may be used as long as the element is capable of controlling a current.

As a switching element, a diode may be used or a logical circuit in which a diode and a transistor are combined may be used as well.

Further, in the invention, a kind of a transistor capable of using as a switching element is not limited, and a TFT using a non-single crystalline semiconductor film typified by amorphous silicon or polycrystalline silicon, a MOS transistor formed by using a semiconductor substrate or an SOI substrate, a junction transistor, a bipolar transistor, a transistor using an organic semiconductor or a carbon nanotube, other transistors can be applied. In addition, a kind of a substrate in which a transistor is formed is not limited, and a single crystal semiconductor substrate, an SOI substrate, a quartz substrate, a glass substrate, a resin substrate, or the like can be freely used.

A transistor is operated as just a switching element, and polarity (conductivity type) is not particularly limited and either an N type transistor or a P type transistor may be used. However, in a case where a lower OFF current is desirable, a transistor which has a lower OFF current characteristic is desired to be used. As the lower OFF current transistor, there is a transistor provided with a region (called an LDD region) in which am impurity element is added to impart conductive type at a low concentration between a channel forming region and a source or drain region.

Further, in a case where a transistor is operated when a value of a source potential of the transistor is closer to a low potential side power supply than that of a drain potential, the transistor is desirably an N type. On the other hand, in the case where a transistor is operated at a state where a source potential is close to a high potential side power supply, the transistor is desirably a P type. To have such a structure can increase an absolute value of a voltage between the gate and the source of the transistor; therefore, the transistor is easily operated as a switch. Note that both an N type transistor and a P type transistor may be used to be a CMOS transistor as a switching element.

The invention can be applied to a display device using an element which has a proportional relation between luminance and a current value flowing to a pair of electrodes as a light emitting element. For example, a display device using an EL element or a light emitting diode as a light emitting element can be applied.

Effect of the Invention

In the invention, in each pixel, a voltage corresponding to a threshold voltage of a light emitting element is held in a capacitor, and a voltage obtained by adding the threshold voltage to a predetermined voltage is applied to the light emitting element. Therefore, without depending on the threshold voltage of the light emitting element, the light emitting element can emit light. Thus, even when the threshold voltage of the light emitting element varies between pixels or even when the light emitting element deteriorates, a proper gradation can be displayed without receiving the effect, and a display device capable of high quality display can be provided.

Moreover, the invention uses a voltage as a video signal, therefore, structure of a driver circuit which inputs a video signal to a pixel can be simplified.

In addition, in Structure 3 and Structure 4 of the invention, the transistor arranged in each pixel functions just as a switching element, therefore, power consumption of the display device can be reduced.

BEST MODE FOR CARRYING OUT THE INVENTION

Although the present invention will be fully described by way of embodiment modes with reference to the drawings, it is to be understood that various changes and modifications will be apparent to those skilled in the art. Therefore, unless such changes and modifications depart from the scope of the present invention, they should be construed as being included therein.

Embodiment Mode 1

As for the display device of Structure 3 described in [Means for Solving the Problem], description is made on a pixel configuration with reference to FIG. 1.

In FIG. 1, each pixel has capacitor 101, a light emitting element 102, and a TFT 103, and reference numeral 104 denotes a source signal line, 105 denotes a gate signal line, 106 denotes a light emitting control line, 107 denotes a node Vm, and 108 denotes the other electrode of a pair of electrodes of the light emitting element 102.

One electrode of the capacitor 101 is connected to the light emitting control line 106, the other electrode of the capacitor 101 is connected to one electrode of the light emitting element 102 and one of the source or the drain of the TFT 103, the other of the source of the drain of the TFT 103 is connected to the source signal line 104, and a gate of the TFT 103 is connected to the gate signal line 105.

A junction of the other electrode of the capacitor 101 and one electrode of the light emitting element 102 is the node Vm 107.

Description is made on a driving method of the pixel shown in FIG. 1 with reference to a timing chart in FIG. 2.

Description is made on a method of holding a threshold voltage of the light emitting element 102 in the capacitor 101. The threshold voltage of the light emitting element 102 is denoted by Vth in FIG. 2. In a Data writing period denoted by T1 in FIG. 2, the TFT 103 is set in an ON state, and a potential given to the source signal line 104 is inputted to the node Vm 107. Here, a potential difference between the potential given to the source signal line 104 and a potential of the other electrode 108 of the light emitting element 102 may be set to be equal to or higher than the threshold voltage of the light emitting element 102. The potential given to the source signal line 104 is denoted by Vdata in FIG. 2. The potential of the other electrode 108 of the light emitting element 102 is denoted by Vo in FIG. 2. Further, a capacitance value of the capacitor 101 is denoted by C101 in FIG. 2 and a capacitance value of the light emitting element 102 is denoted by Cel in FIG. 2. Thus, a voltage corresponding to a potential difference between a potential of the source signal line 104 and a potential of the light emitting control line 106 is held in the capacitor 101. Subsequently, in a period of obtaining a threshold voltage of a light emitting element denoted by T2 in FIG. 2, when the TFT 103 is set in an OFF state, a potential of the node Vm 107 decreases. The decrease of the potential of the node Vm 107 continues until a potential difference between the potential of the node Vm 107 and the potential of the other electrode 108 of the light emitting element 102 becomes equal to the threshold voltage of the light emitting element 102. Thus, the value of the potential of the node Vm 107 corresponds to the threshold voltage of the light emitting element 102.

Next, in a display period denoted by T3 in FIG. 2, the potential of the light emitting control line 106 connected to the capacitor 101 is increased by only Vg. Thus, a potential of the other electrode of the capacitor 101, that is, the potential of the node Vm 107 is increased by a voltage obtained by capacity-dividing the increased voltage Vg of the light emitting control line 106 by the capacitor 101 and the light emitting element 102. That is, the potential of the node Vm 107 is increased by (C101/C101+Cel))×Vg. Here, in a period of obtaining a threshold voltage of a light emitting element denoted by T2 in FIG. 2, the potential difference between the potential of the node Vm 107 and the potential of the other electrode 108 of the light emitting element 102 is the threshold voltage of the light emitting element 102. Therefore, in the display period T3, when the potential of the light emitting control line 106 is increased by only Vg, the potential difference between the potential of the node Vm 107 and the potential of the other electrode 108 of the light emitting element 102 becomes a sum ((C101/(C101+Cel))×Vg+Vth) of the threshold voltage of the light emitting element 102 and the voltage obtained by capacity-dividing the increased voltage Vg of the light emitting control line 106 by the capacitor 101 and the light emitting element 102. Therefore, a voltage obtained by correcting the threshold voltage of the light emitting element 102 can be applied to the light emitting element 102, thereby the light emitting element 102 can be in a light emitting state.

Here, description is made on a method of expressing a gradation. A display device of the invention can express a gradation by an analog voltage gradation method or a digital time gradation method. In the analog voltage gradation method, a gradation is expressed by changing the value of Vg in FIG. 2 in a analog manner. In the digital time gradation method, one frame is divided into a plurality of subframes in which light emitting time is different (the light emitting time may be the same as well), and a light emitting state or a non-light emitting state of the light emitting element 102 is selected in each subframe. Then, time in which the light emitting state is selected per one frame is controlled to express a gradation.

Although the analog voltage gradation method and the digital time gradation method are described above, another method can express a gradation as well. One frame is divided into a plurality of subframes in which Vg shown in FIG. 2 is different (Vg may be the same as well), and a light emitting state or a non-light emitting state of the light emitting element 102 is selected in each subframe. Then, a sum of a charge supplied to the light emitting element 102 per one frame is controlled to express a gradation.

In the digital time gradation method, regardless of gradation to express, the potential of the light emitting control line 106 is increased by only the constant voltage Vg in the display period T3. Therefore, when a non-light emitting state is selected, the potential of the node Vm 107 is required to be set low so as not to be a light emitting state of the light emitting element 102 even when the potential of the light emitting control line 106 is increased by only the voltage Vg in the display period T3. Hereinafter, an operation to set the potential of the node Vm 107 low is referred to as an erasing operation. Description is made on the erasing operation with reference to FIGS. 1 and 2 below.

In the Data writing period denoted by T1 in FIG. 2, the TFT 103 is set in an ON state, and a potential given to the source signal line 104 is inputted to the node Vm 107. In an erasing operation, the potential given to the source signal line 104 is equal to or less than a voltage in which an absolute value of a voltage (C101/(C101+Cel))×Vg shown in FIG. 2 is subtracted from the threshold voltage of the light emitting element 102 with respect to the potential of the other electrode 108 of the light emitting element 102. Subsequently, in the period of obtaining a threshold voltage of a light emitting element denoted by T2 in FIG. 2, even when the TFT 103 is set in an OFF state, the potential of the node Vm 107 does not change. In the display period T3 in FIG. 2, even when the potential of the light emitting control line 106 is increased by only the voltage (C101/(C101+Cel))×Vg, the potential difference between the potential of the node Vm 107 and the potential of the other electrode 108 of the light emitting element 102 is equal to or less than the threshold voltage of the light emitting element 102. Therefore, the light emitting element 102 can be in a non-light emitting state.

In the digital time gradation method, as a method of selecting a non-light emitting state, there is a different method other than the method of performing the aforementioned erasing operation. In the display period T3, the potential of the light emitting control line 106 is not changed so that a non-light emitting state may be selected as well.

Further, in the invention, a known driver circuit which inputs a signal to a pixel can be used.

In the analog voltage gradation method, the light emitting control line 106 is connected to a driving circuit, and the voltage Vg shown in FIG. 2 is controlled by the driving circuit. In the digital time gradation method, the light emitting control line 106 is connected to an external circuit via an FPC, and a clock signal is supplied to the light emitting control line 106.

By the display device of the invention and the driving method thereof shown in FIGS. 1 and 2, even when the threshold voltage of the light emitting element 102 varies between pixels or even when the light emitting element 102 deteriorates, a proper gradation can be displayed without receiving the effect, and a display device capable of high quality display can be provided.

Embodiment Mode 2

Description is made on a pixel configuration of the display device of Structure 4 described in [Means for Solving the Problem] with reference to FIG. 3.

In FIG. 3, each pixel includes a capacitor 300, a capacitor 301, a light emitting element 302, a TFT 303, a TFT 304 and a TFT 305.

Furthermore, reference numeral 306 denotes a source signal line, 307 denotes a gate signal line, 308 denotes a precharge selection line, 309 denotes a clock signal line, 310 denotes the other electrode of the light emitting element 302, 311 denotes a node Vm, and 312 denotes a power supply line Vpc.

One electrode of the capacitor 301 is connected to the clock signal line 309, the other electrode of the capacitor 301 is connected to one electrode of the light emitting element 302 and one of the source or the drain of the TFT 305, the other of the source or the drain of the TFT 305 is connected to one of the source or the drain of the TFT 304, a gate of the TFT 305 is connected to the precharge selection line 308, a gate of the TFT 304 is connected to one electrode of the capacitor 300 and one of the source or the drain of the TFT 303, the other of the source or the drain of the TFT 304 is connected to the power supply line Vpc 312 and the other electrode of the capacitor 300, the other of the source or the drain of the TFT 303 is connected to the source signal line 306, and a gate of the TFT 303 is connected to the gate signal line 307.

Moreover, a junction of the other electrode of the capacitor 301 and one electrode of the light emitting element 302 corresponds to the node Vm 311.

Next, description is made on a driving method of the pixel shown in FIG. 3 with reference to a timing chart in FIG. 4.

In a driving method of the pixel, description is made on a series of operations until a source signal line selects a light emitting state of a light emitting element. First, description is made on a method in which a threshold voltage of the light emitting element 302 is held in the capacitor 301.

First, the TFT 303 is set in an ON state, and a potential given to the source signal line 306 is inputted to the gate of the TFT 304. At this time, in the case of selecting a light emitting state, the potential given to the source signal line 306 is set to be in an ON state of the TFT 304. Then, the TFT 303 is set in an OFF state. A voltage between the gate and the source of the TFT 303 to be set in an ON state has been held in the capacitor 300. Therefore, the TFT 304 continues to keep the ON state until next time when the TFT 303 is selected by the gate signal line 307.

In a writing period T1 in FIG. 4, the TFT 305 is set in an ON state. The TFT 304 is in the ON state, therefore, when the TFT 305 is in the ON state, a potential of the power supply line Vpc 312 is supplied to the node Vm 311. The potential of the power supply line Vpc 312 is denoted by Vpc in FIG. 4.

An ON state and an OFF state of the TFT 305 are selected by a signal inputted to the precharge selection line 308 shown in FIG. 3. In the configuration shown in FIG. 3, the TFT 305 is an N type transistor, therefore, when the signal of the precharge selection line 308 is Hi, the TFT 305 is in an ON state. In the case where the TFT 305 is a P type transistor, a polarity of the signal of the precharge selection line 308 may be inverted in the timing chart in FIG. 4.

In the period T1, when the TFT 305 is set in an ON state, a potential of the power supply line Vpc 312 is supplied to the node Vm 311. Here, a potential difference between the potential Vpc given to the power supply line Vpc 312 and a potential (Vo) of the other electrode 310 of the light emitting element 302 may be set equal to or higher than the threshold voltage of the light emitting element 302. The potential of the other electrode 310 of the light emitting element 302 is denoted by Vo in FIG. 4. A capacitance value of the capacitor 301 is denoted by C301 in FIG. 4 and a capacitance value of the light emitting element 302 is denoted by Cel in FIG. 4. Thus, a voltage corresponding to a potential difference between a potential of the power supply line Vpc 312 and a potential of the clock signal line 309 is held in the capacitor 301. Subsequently, in a period of obtaining a threshold voltage of a light emitting element denoted by T2 in FIG. 4, when the TFT 305 is set in an OFF state, a potential of the node Vm 311 decreases. The decrease of the potential of the node Vm 311 continues until a potential difference between the potential of the node Vm 311 and the potential of the other electrode 310 of the light emitting element 302 becomes equal to the threshold voltage Vth of the light emitting element 302. Thus, the value of the potential of the node Vm 311 corresponds to the threshold voltage of the light emitting element 302.

Next, in a display period denoted by T3 in FIG. 4, the potential of the clock signal line 309 connected to the capacitor 301 is increased by only Vg. Thus, a potential of the other electrode of the capacitor 301, that is, the potential of the node Vm 311 is increased by a voltage obtained by capacity-dividing the increased voltage Vg of the clock signal line 309 by the capacitor 301 and the light emitting element 302, that is, the potential of the node Vm 311 is increased by (C301/(C301+Cel))×Vg. Here, in the period of obtaining a threshold voltage of the light emitting element denoted by T2 in FIG. 4, a potential difference between the potential of the node Vm 311 and the potential of the other electrode 310 of the light emitting element 302 is the threshold voltage of the light emitting element 302. Therefore, in the display period T3, when the potential of the clock signal line 309 is increased by only Vg, the potential difference between the potential of the node Vm 311 and the potential of the other electrode 310 of the light emitting element 302 is increased by a voltage obtained by capacity-dividing the increased voltage Vg of the clock signal line 309 by the capacitor 301 and the light emitting element 302, that is, (C301/(C301+Cel))×Vg, thereby the potential of the light emitting element 302 becomes a sum ((C301/(C301+Cel))×Vg+Vth) of the threshold voltage of the light emitting element 302 and the increased voltage of the potential difference. According, a voltage obtained by correcting the threshold voltage of the light emitting element 302 can be applied to the light emitting element 302.

Next, description is made on an operation in the case of selecting a non-light emitting state.

The TFT 303 is set in an ON state, and a potential given to the source signal line 306 is inputted to the gate of the TFT 304. At this time, in the case of selecting a non-light emitting state, the potential given to the source signal line 306 is set to be set in an OFF state of the TFT 304. Then, the TFT 303 is set in an OFF state. A voltage between the gate and the source of the TFT 303 to be set in an OFF state of the TFT 303 has been held in the capacitor 300. Therefore, the TFT 304 continues to keep the OFF state until next time when the TFT 303 is selected by the gate signal line 307.

In the writing period T1 in FIG. 4, the TFT 305 is set in an ON state. The TFT 304 is in the OFF state; therefore, even when the TFT 305 is set in an ON state, the potential of the node Vm 311 is not changed.

Subsequently, in the period of obtaining a threshold voltage of a light emitting element denoted by T2 in FIG. 4, the TFT 305 is set in an OFF state.

Next, in the display period denoted by T3 in FIG. 4, the potential of the clock signal line 309 connected to the capacitor 301 is increased by only Vg. Even when the potential of the clock signal line 309 is increased by only Vg, the potential difference between the potential of the node Vm 311 and the potential of the other electrode 310 of the light emitting element 302 is equal to or less than the threshold voltage of the light emitting element 302.

Description below is a reason why the potential difference between the potential of the node Vm 311 and the potential of the other electrode 310 of the light emitting element 302 is equal to or less than the threshold voltage of the light emitting element 302 in the case of selecting a non-light emitting state, in the display period denoted by T3 in FIG. 4.

In the case of selecting a non-light emitting state after selecting a light emitting state, before the writing period T1, the potential difference between the potential of the node Vm 311 and the potential of the other electrode 310 of the light emitting element 302 is the threshold voltage of the light emitting element 302. During the writing period T1, when the potential of the clock signal line 309 becomes low and decreases by only (C301/(C301+Cel))×Vg, the potential difference between the potential of the node Vm 311 and the potential of the other electrode 310 of the light emitting element 302 is a voltage (Vth−|(C301/(C301+Cel))×Vg|) in which an absolute value of (C301/(C301+Cel))×Vg is subtracted from the threshold voltage of the light emitting element 302. Therefore, even when the potential of the clock signal line 309 becomes Hi next time, the potential difference between the potential of the node Vm 311 and the potential of the other electrode 310 of the light emitting element 302 does not become equal to or higher than the threshold voltage of the light emitting element 302.

Thus, the light emitting element 302 can be in a non-light emitting state.

By the display device of the invention and the driving method thereof as shown in FIGS. 3 and 4, even when the threshold voltage of the light emitting element 302 varies between pixels or even when the light emitting element 302 deteriorates, a proper gradation can be displayed without receiving the effect, and a display device capable of high quality display can be provided. Further, by a similar method to Embodiment Mode 1, a gradation can be expressed.

Note that in FIG. 3, although the other electrode of the capacitor 300 is connected to the power supply line Vpc 312, the other electrode of the capacitor 300 may be connected anywhere as long as a constant potential is maintained when an operation of the TFT 304.

Note that when the TFT 305 is in an ON state, the power supply line Vpc 312 may be connected to the gate signal line 307, may be connected to the precharge selection line 308, or may be connected to the clock signal line 309 as long as it maintains a predetermined potential.

Furthermore, the precharge selection line 308 and the clock signal line 309 are connected to an external circuit via an FPC, respectively. These signal lines may be connected to the external circuit via a level shift circuit, an inverter circuit and the like.

It is to be noted that a clock signal having a constant duty ratio is supplied to the precharge selection circuit 308 and the clock signal line 309, respectively. Therefore, the signal supplied to the precharge selection circuit 308 and the clock signal line 309 may be inputted directly from the external circuit via the FPC without a driving circuit for controlling timing.

In Embodiment Mode 1 and Embodiment Mode 2, a TFT arrangement is described with reference to FIGS. 1 and 3. However, in the invention, the TFT arrangement is not limited to the arrangements in FIGS. 1 and 3. If a pixel can be operated by the timing chart shown in FIG. 2 or 4, a TFT can be arranged in an arbitrary place. Moreover, although an N type TFT is described as the TFT in FIGS. 1 and 3, the polarity of each TFT is not limited thereto.

Note that in the invention, a known driver circuit which inputs a signal to a pixel can be used.

Embodiment 1

In this embodiment, description is made on a display device having a pixel configuration described in FIG. 1 or 3 in a Best Mode for Carrying Out the Invention. FIG. 5 shown a structure example of a display device. The display device has a display portion 505 in which a plurality of pixels 500 are arranged in matrix of m rows (m is a natural number) and n columns (n is a natural number), and at the periphery of the display portion 505, there are a source signal line driver circuit 503, a gate signal line driver circuit for writing 504, and a gate signal line driver circuit for erasing 507. Source signal lines 501 denoted by S1 to Sn are arranged corresponding to each column of the pixels 500, and gate signal lines 502 denoted by G1 to Gm are arranged corresponding to each row of the pixels 500.

The source signal line 104 in FIG. 1 corresponds to the source signal line 501 in FIG. 5. The gate signal line 105 in FIG. 1 corresponds to the gate signal line 502 in FIG. 5. The source signal line 306 in FIG. 3 corresponds to the source signal line 501 in FIG. 5. The gate signal line 307 in FIG. 3 corresponds to the gate signal line 502 in FIG. 5. Note that the other wires shown in FIGS. 1 and 3 are not shown in FIG. 5.

In the display device shown in FIG. 5, a drive is used which can write and erase by one gate signal line 502 by dividing one gate selection period into a writing period and an erasing period.

Note that a known configuration may be used for the source signal line driver circuit 503, the gate signal line driver circuit for writing 504, and the gate signal line driver circuit for erasing 507.

Embodiment 2

Description is made on an example of actually manufacturing a display device of the invention.

FIGS. 7A and 7B are cross sectional views which show the pixel of the display device of Structure 3 or Structure 4 described in Best Mode for Carrying Out the Invention. Described is an example using a TFT as a transistor arranged in the pixel of Structure 3 or Structure 4.

In FIGS. 7A and 7B, reference numeral 1000 denotes a substrate, 1001 denotes a base film, 1002 denotes a semiconductor layer, 1102 denotes a semiconductor layer, 1003 denotes a first insulating film, 1004 denotes a gate electrode, 1104 denotes an electrode, 1005 denotes a second insulating film, 1006 denotes an electrode, 1007 denotes a first electrode, 1008 denotes a third insulating film, 1009 denotes a light emitting layer, 1010 denotes a second electrode, 1100 denotes a TFT, 1011 denotes a light emitting element, and 1101 denotes a capacitor.

In FIGS. 7A and 7B, the TFT 1100 and the capacitor 1101 are typically shown as elements constituting a pixel.

Description is made on a structure of FIG. 7A.

As the substrate 1000, for example, a glass substrate such as a barium borosilicate glass or an alumino-borosilicate glass, a quartz substrate, a ceramic substrate or the like can be used. Further, a substrate obtained by forming an insulating film over a surface of a metal substrate containing stainless or of a semiconductor substrate may be used, and a substrate formed of a synthetic resin having flexibility such as plastic may be used as well. Note that a surface of the substrate 1000 may be planarized by polishing such as a CMP method.

As the base film 1001, an insulating film such as silicon oxide, silicon nitride, or silicon nitride oxide can be used. By the base film 1001, an alkaline metal such as Na or an alkaline earth metal contained in the substrate 1000 can prevent from diffusing in the semiconductor layer 1002 and affecting adversely on the characteristics of the TFT 1100. In FIG. 7A, although the base film 1001 has a monolayer structure, a plurality of layers of two layers or more may be used as well. Note that in the case of using a substrate in which impurity diffusion does not become a problem so much such as a quartz substrate, the base film 1001 is not necessarily required to be provided.

As the semiconductor layer 1002 and the semiconductor layer 1102, a crystalline film or an amorphous semiconductor film which is patterned can be used. A crystalline semiconductor film can be obtained by crystallizing an amorphous semiconductor film. As a crystallization method, a laser crystallization method, a thermal crystallization method using an RTA or an annealing furnace, a thermal crystallization method using a metal element to promote crystallization, or the like can be used. The semiconductor layer 1002 has a channel forming region and a pair of impurity regions in which an impurity element is added to impart conductive type. Note that between the channel forming region and at least one of the pair of impurity regions, an impurity region in which the impurity element is added at a low concentration may be provided as well. The semiconductor layer 1102 can have a structure in which an impurity element is added entirely to impart conductivity type.

As the first insulating film 1003, a monolayer or a stacked layer of a plurality of films can be formed using silicon oxide, silicon nitride, silicon nitride oxide or the like.

As the gate electrode 1004 and the electrode 1104, a monolayer structure or a stacked layer structure formed of an alloy or a compound including one kind of element selected from Ta, W, Ti, Mo, Al, Cu, Cr, and Nd or a plurality of the elements, can be used.

The TFT 1100 is structured by the semiconductor layer 1002, the gate electrode 1004, and the first insulating film 1003 interposed between the semiconductor layer 1002 and the gate electrode 1004. As a TFT forming a pixel, although only the TFT 1100 electrically connected to the first electrode 1007 of the light emitting element 1011 is shown in FIG. 7A, a structure in which a pixel portion has a plurality of TFTs may be used as well. Further, although the TFT 1100 is described as a top-gate transistor in this embodiment, a bottom-gate transistor having a gate electrode below a semiconductor layer may be used, or a dual-gate transistor having a gate electrode above and below a semiconductor layer may be used as well.

The capacitor 1101 is structured by the first insulating film 1003 as a dielectric and the semiconductor layer 1102 and the electrode 1104 as a pair of electrodes which are opposed each other with the first insulating film 1003 interposed therebetween. Note that as the capacitor 1101 included in the pixel, description is made on an example in which one electrode of the pair of electrodes is the semiconductor layer 1102 formed at the same time as the semiconductor layer 1002 of the TFT 1100 while the other electrode thereof is the electrode 1104 formed at the same time as the gate electrode 1004 of the TFT 1100 in FIG. 7A. However the structure is not limited to this structure.

As the second insulating film 1005, a monolayer or stacked layer of an inorganic insulating film or an organic insulating film can be used. As the inorganic insulating film, a silicon oxide film formed by a CVD method, a silicon oxide film applied by a SOG (Spin On Glass) method, or the like can be used while as the organic insulating film, a film such as polyimide, polyamide, BCB (benzocyclobutene), acrylic, a positive photosensitive organic resin, or a negative photosensitive organic resin can be used.

Further, as the second insulating film 1005, a skeleton structure is composed by the bond of silicon (Si) and oxygen (O). A compound including an organic group containing at least hydrogen (such as an alkyl group or aromatic hydrocarbon) can be used as a substituent. Alternatively, a fluoro group may be used as the substituent. Further alternatively, a fluoro group and an organic group containing at least hydrogen may be used as the substituent. A typical example of these materials is a polymer containing siloxane.

As the electrode 1006, a monolayer or a stacked layer structure formed of an alloy including one kind of element selected from Al, Ni, C, W, Mo, Ti, Pt, Cu, Ta, Au, and Mn or a plurality of the element can be used.

One or both of the first electrode 1007 and the second electrode 1010 can be a transparent electrode. As the transparent electrode, indium tin oxide (ITO), zinc oxide (ZnO), indium zinc oxide (IZO), zinc oxide added gallium (GZO), or other translucent oxide conductive material can be used. In addition, indium tin oxide containing ITO and silicon oxide (hereinafter referred to as ITSO), indium tin oxide containing ITO and titanium oxide (hereinafter referred to as ITTO), indium tin oxide containing ITO and molybdenum oxide (hereinafter referred to as ITMO), ITO added with titanium, molybdenum, or gallium, indium oxide containing silicon oxide added with zinc oxide (ZnO) of 2 to 20 atomic % may be used as well.

One of the first electrode 1007 and the second electrode 1010 may be formed of a material without light-transmitting property. For example, an alkaline metal such as Li or Cs, an alkaline earth metal such as Mg, Ca, or Sr, an alloy including them (Mg:Ag, Al:Li, Mg:In or the like), a compound of these ($CaF_2$, calcium nitride), or a rare earth metal such as Yb or Er can be used.

A material similar to that of the second insulating film 1005 can be used to form the third insulating film 1008. The third insulating film 1008 is formed in the peripheral of the first electrode 1007 so as to cover the end portions of the first electrode 1007, and has a function to separate the light emitting layer 1009 in adjacent pixels.

The light emitting layer 1009 is structured by a monolayer or a plurality of layers. In the case of structuring by a plurality of layers, these layers are classified, in view of carrier transport properties, in a hole injecting layer, a hole transporting layer, a light emitting layer, an electron transporting layer, an electron injecting layer, or the like. Note that boundaries of each layer is not required to be clear, and there are some cases where materials forming respective layers are partially mixed, therefore, interfaces are not defined clearly. An organic material or an inorganic material may be used for each layer. Further, as the organic material, any of a polymeric material, a middle molecular weight material, and a low molecular weight material may be used.

The light emitting element 1011 is structured by the light emitting layer 1009, the first electrode 1007 and the second electrode 1010 which are overlapped each other through the light emitting layer 1009. One of the first electrode 1007 and the second electrode 1010 corresponds to an anode, and the other thereof correspond to a cathode. When a voltage higher than a threshold voltage is applied between the anode and the cathode in forward bias, a current flows from the anode to the cathode, therefore, the light emitting element 1011 emits light.

Description is made on a structure of FIG. 7B. Note that the same reference numerals are used for the same portions as FIG. 7A, and description thereof is omitted.

FIG. 7B is a structure including an insulating film 1108 between the second insulating film 1005 and the third insulating film 1008 in FIG. 7A.

Moreover, the electrode 1006 and the first electrode 1007 are connected through an electrode 1106 in a contact hole provided in the insulating film 1108.

The insulating film 1108 can have a structure similar to the second insulating film 1005. The electrode 1106 can have a structure similar to the electrode 1006.

This embodiment can be implemented freely combining with Best Mode for Carrying Out the Invention or Embodiment 1.

Embodiment 3

In this embodiment, description is made on a structure of a sealed display device with reference to FIGS. 8A to 8C. FIG. 8A is a top plan view of a display panel formed by sealing a display device, and each of FIGS. 8B and 8C is a cross sectional view cutting along a line A-A' of FIG. 8A. Note that FIGS. 8B and 8C are examples performing a sealing in different methods.

In FIGS. 8A to 8C, a display portion 1302 having a plurality of pixels is arranged over a substrate 1301, and to surround the display portion 1302, a sealing material 1306 is provided to stick a sealing material 1307. As for a pixel configuration, structures of Best Mode for Carrying Out the Invention, Embodiment 1 and Embodiment 2 described above can be used.

A display panel in FIG. 8B, the sealing material 1307 in FIG. 8A corresponds to an opposing substrate 1321. The sealing material 1306 is used as an adhesive layer and the opposing substrate 1321 is stuck thereto. The structure 1301, the opposing substrate 1321, and the sealing material 1306 form a closed space 1322. A color filter 1320 and a protective film 1323 to protect the color filter are provided to the opposing substrate 1321. Light emitted from a light emitting element arranged in the display portion 1302 is emitted outside through the color filter 1320. The closed space 1322 is filled with an inert resin, a liquid, or the like. Note that as the resin to fill the closed space 1322, a resin having a light-transmitting property in which a moisture absorption material is dispersed may be used as well. Further, materials filling the sealing material 1306 and the closed space 1322 may be the same material, and adhesion of the opposing substrate 1321 and a sealing of the display portion 1302 may be performed at the same time.

A display panel shown in FIG. 8C, the sealing material 1307 in FIG. 8A corresponds to a sealing material 1324. The sealing material 1306 is used as an adhesive layer and the sealing material 1324 is stuck thereto. The substrate 1301, the sealing material 1306, and the sealing material 1324 form a closed space 1308. An absorbent 1309 is provided in a concave portion of the sealing material 1324 in advance, and inside the closed space 1308, moisture, oxygen, or the like is absorbed to keep a clean atmosphere so that deterioration of the light emitting element is suppressed. The concave portion is covered with a cover material 1310 in a fine mesh. Although air and moisture are passed through the cover material 1310, they are not passed though the absorbent 1309. Note that the closed space 1308 may be filled with a rare gas such as nitrogen or argon, and can be filled with a resin or a liquid as along as it is inert.

Over the substrate 1301, provided is an input terminal portion 1311 for transmitting a signal to the display portion 1302 and the like, a signal such as a video signal is transmitted to the input terminal portion 1311 through an FPC (Flexible Printed Circuit) 1312. In the input terminal portion 1311, a wire formed over the substrate 1301 is electrically connected to a wire provided over the FPC 1312 by using a resin (anisotropic conductive resin: ACF) in which a conductor is dispersed.

Over the substrate 1301 over which the display portion 1302 is formed, a driver circuit to input a signal to the display portion 1302 may be integrally formed. A driver circuit to input a signal to the display portion 1302 may be formed by the IC chip and connected over the substrate 1301 by a COG (Chip On Glass), or an IC chip may be arranged over the substrate 1301 by using a TAB (Tape Auto Bonding) or a printed board.

This embodiment can be implemented freely combining with Best Mode for Carrying Out the Invention, Embodiment 1 and Embodiment 2.

Embodiment 4

The invention can be applied to a display module in which a circuit to input a signal into a display panel is mounted onto the display panel.

FIG. 9 shows a display module in which a display panel 900 and a circuit board 904 are combined.

In FIG. 9, description is made on an example in which a control circuit 905, a signal division circuit 906, and the like are formed over the circuit board 904. A circuit formed over the circuit board 904 is not limited thereto. Any circuit which generates a signal to control a display panel may be formed as well.

Signals outputted from these circuits formed over the circuit board 904 are inputted to the display panel 900 through a connection wire 907.

The display panel 900 has a display portion 901, a source signal line driver circuit 902, and a gate signal line driver circuit 903. A structure of the display panel 900 can have a structure similar to a structure described in Embodiment 2 or the like. FIG. 9 shows an example in which the source signal line driver circuit 902 and the gate signal line driver circuit 903 are formed over the same substrate as the substrate over which the display portion 901 is formed. However, the display module of the invention is not limited thereto. Only the gate signal line driver circuit 903 may be formed over the same substrate as the substrate over which the display portion 901 is formed, and a source signal line driver circuit may be formed over a circuit board. Both a source signal line driver circuit and a gate signal line driver circuit may be formed over a circuit board as well.

Display portions of various electronic apparatuses can be formed with such display modules incorporated therein.

This embodiment can be implemented freely combining with Best Mode for Carrying Out the Invention, and Embodiments 1 to 3.

Embodiment 5

As an electronic apparatus using the display module of the invention, there are a camera such as a video camera and a digital camera, a goggle type display (a head mounted display), a navigation system, an audio reproducing device (a car audio, an audio component and the like), a notebook personal computer, a game machine, a portable information terminal (a mobile computer, a mobile phone, a portable game machine, an electronic book, or the like), an image reproducing device provided with a recording medium (specifically, a device which reproduces a recording medium such as a Digital Versatile Disc (DVD), and is provided with a display capable of displaying the image), and the like. In particular, for a portable information terminal of which display tends to be looked from an oblique direction, the range of a viewing angle is emphasized, therefore, it is desired to use a self-luminous display device. The invention is particularly effective on a portable information apparatus in which power consumption reduction is an important problem.

Specific examples of electronic apparatuses are described in FIGS. 6A to 6H. Note that electronic apparatuses described here are just a few examples, and it is not limited to these applications.

FIG. 6A shows a display (a display device) including a housing 2001, a support base 2002, a display portion 2003, speaker portions 2004, a video input terminal 2005, and the like. The display module of the invention can be used for the display portion 2003. Note that the display includes all display devices for displaying information such as a display device for a personal computer, for TV broadcast receiver, and for advertisement display.

FIG. 6B shows a digital camera (a digital still camera) including a main body 2101, a display portion 2102, an image receiving portion 2103, operation keys 2104, an external connection port 2105, a shutter 2106, and the like. The display module of the invention can be used for the display portion 2102.

FIG. 6C shows a notebook personal computer including a main body 2201, a housing 2202, a display portion 2203, a keyboard 2204, an external connection port 2205, a pointing pad 2206, and the like. The display module of the invention can be used for the display portion 2203.

FIG. 6D shows a mobile computer including a main body 2301, a display portion 2302, a switch 2303, operation keys 2304, an infrared port 2305, and the like. The display module of the invention can be used for the display portion 2302.

FIG. 6E shows a portable image reproducing device (specifically, a DVD reproducing device) provided with a recording medium, including a main body 2401, a housing 2402, a display portion A 2403, a display portion B 2404, a recording medium (DVD and the like) reading portion 2405, an operation key 2406, a speaker portion 2407, and the like. The display portion A 2403 mainly displays image data while the display portion B 2404 mainly displays character data. However, the display module of the invention can be used for the display portion A 2403 and the display portion B 2404. Note that an image reproducing device provided with a recording medium includes a home game machine and the like.

FIG. 6F shows a goggle type display (a head mounted display) including a main body 2501, a display portion 2502, an arm portion 2503, and the like. The display module of the invention can be used for the display portion 2502.

FIG. 6G shows a video camera including a main body 2601, a display portion 2602, a housing 2603, an external connection port 2604, a remote control receiving portion 2605, an image receiving portion 2606, a battery 2607, a sound input portion 2608, operation keys 2609, an eyepiece portion 2610, and the like. The display module of the invention can be used for the display portion 2602.

Here, FIG. 6H shows a mobile phone including a main body 2701, a housing 2702, a display portion 2703, a sound input portion 2704, a sound output portion 2705, an operation key 2706, an external connection port 2707, an antenna 2708, and the like. The display module of the invention can be used for the display portion 2703. Note that the display portion 2703 displays a white character on a black background, therefore, the power consumption of the mobile phone can be suppressed further.

Note that when the light emission luminance of a light emitting element increases in the future, outputted light including image data can be enlarged and projected by a lens or the like to be used for a front type projector or a rear type projector.

Further, the aforementioned electronic apparatuses display data distributed on a telecommunication line such as the Internet or a CATV (cable television) in many cases, and particularly, the opportunity to display video data increase. The response speed of a light emitting material (a speed from applying a current to a light emitting element including a light emitting material to emitting light) is extremely high, therefore, the display module of the invention is preferable for displaying video data.

Moreover, the display device of the invention consumes electricity in a light emitting portion; therefore, it is desirable to display data so as to minimize the light emitting portion. Accordingly, in the case of using the display module for a display portion which has mainly character data such as a portable information terminal, particularly a mobile phone or an audio reproducing device, it is desirable to drive so as to form character data in a light emitting portion while a non-light emitting portion used as a background.

As set forth above, the applied range of the invention is extremely wide, therefore, the invention can be used for electronic apparatuses of various fields.

This embodiment can be implemented freely combining with Best Mode for Carrying Out the Invention, and Embodiments 1 to 4.

Figure 1:
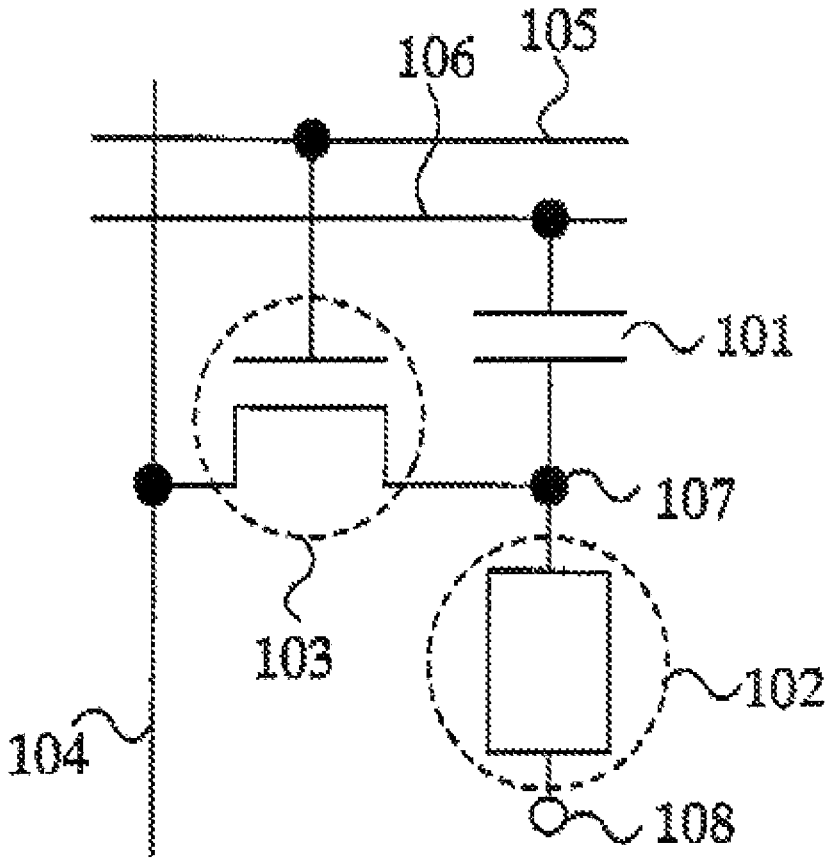
FIG. 1 A circuit diagram showing a pixel configuration of the invention.
Figure 2:
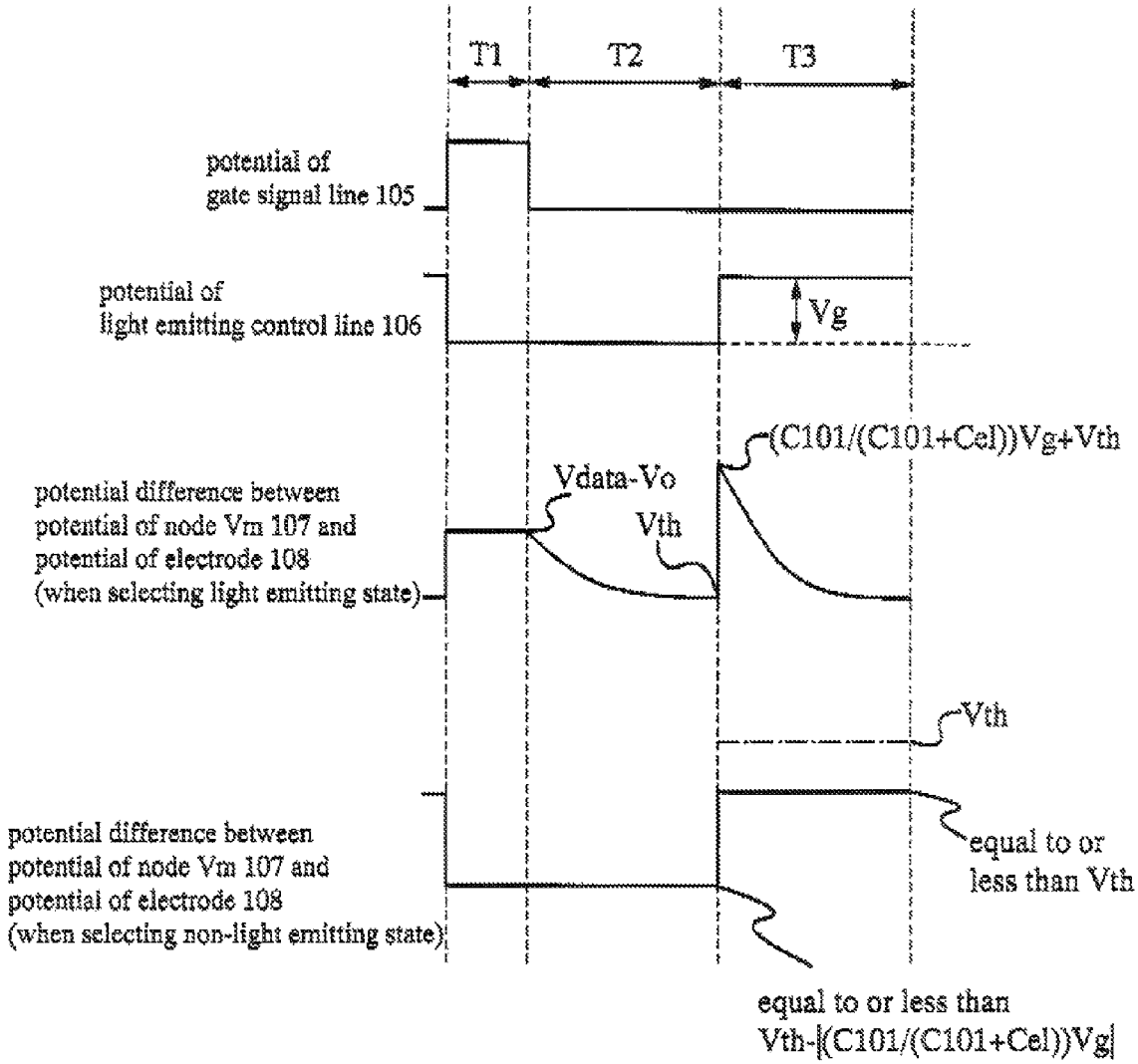
FIG. 2 A diagram showing a timing chart of a pixel of the invention.
Figure 3:
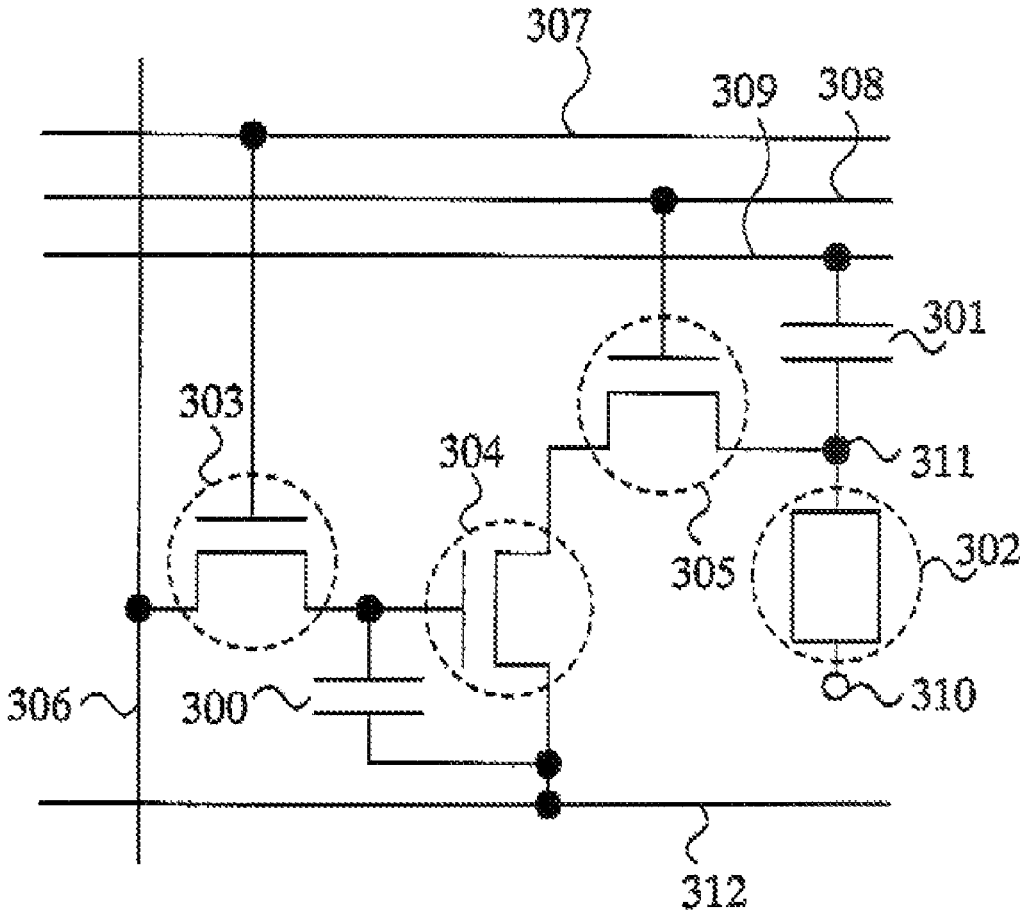
FIG. 3 A circuit diagram showing a pixel configuration of the invention.
Figure 4:
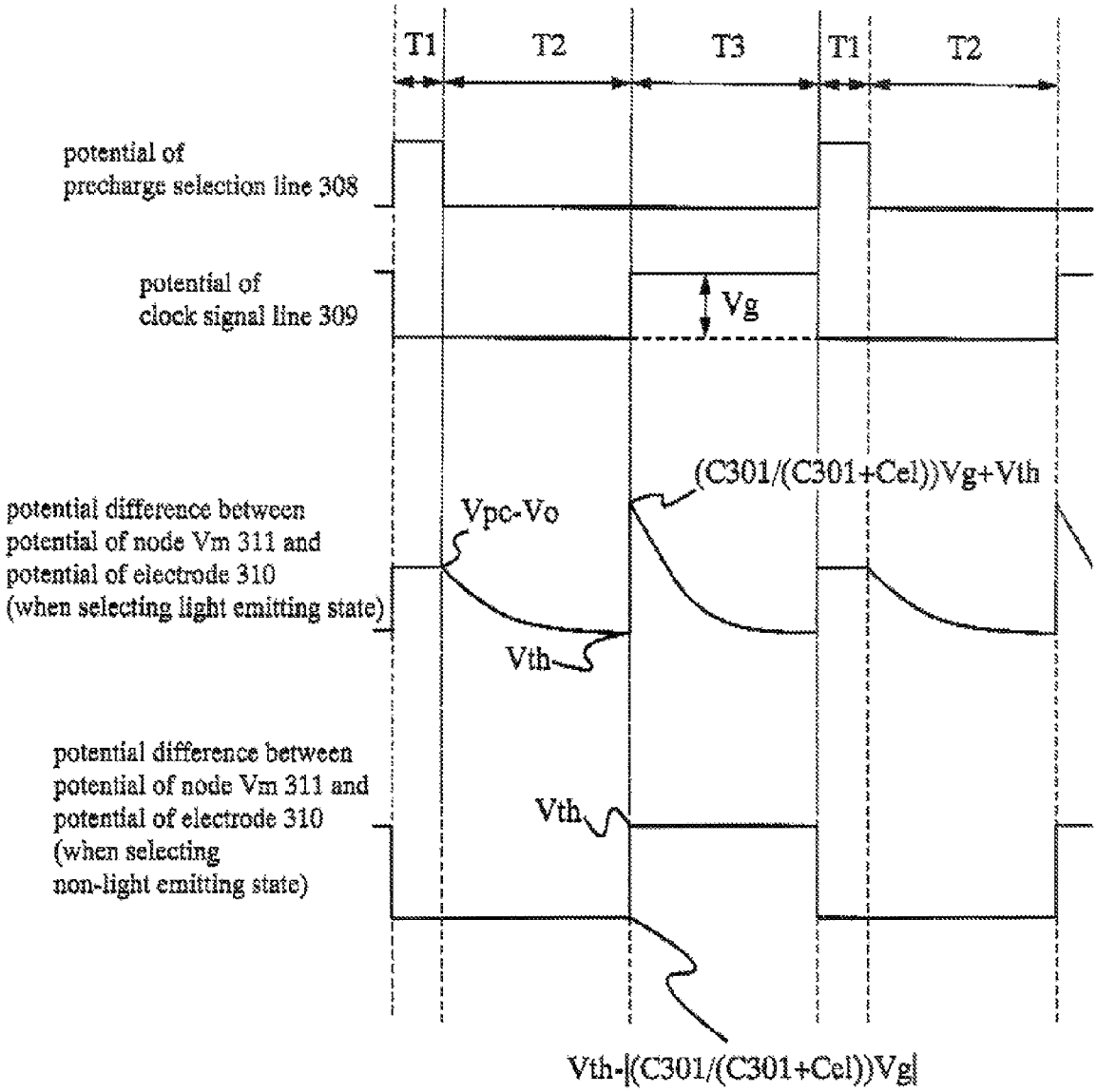
FIG. 4 A diagram showing a timing chart of a pixel of the invention.
Figure 5:
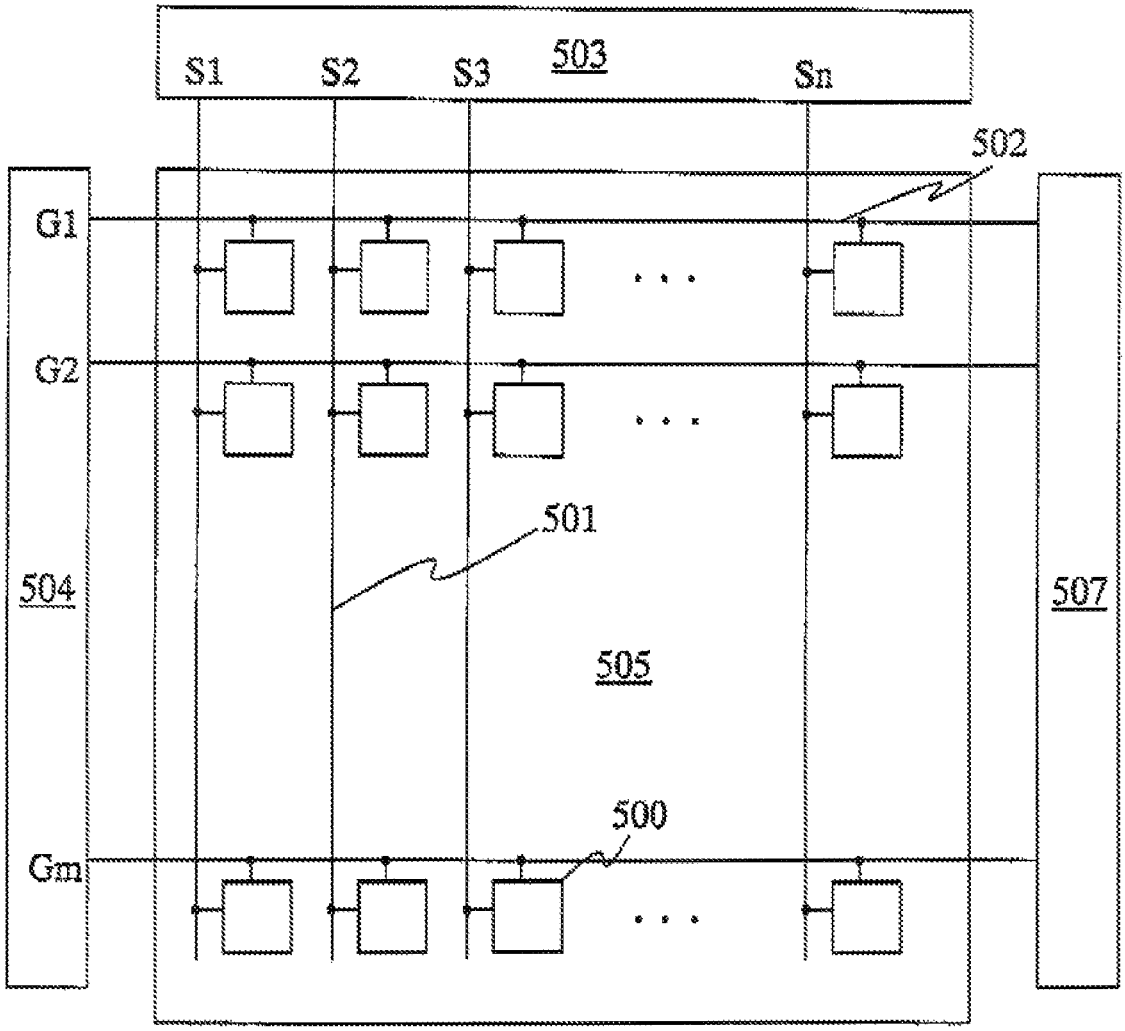
FIG. 5 A diagram showing Embodiment 1 of the invention.
Figure 6:
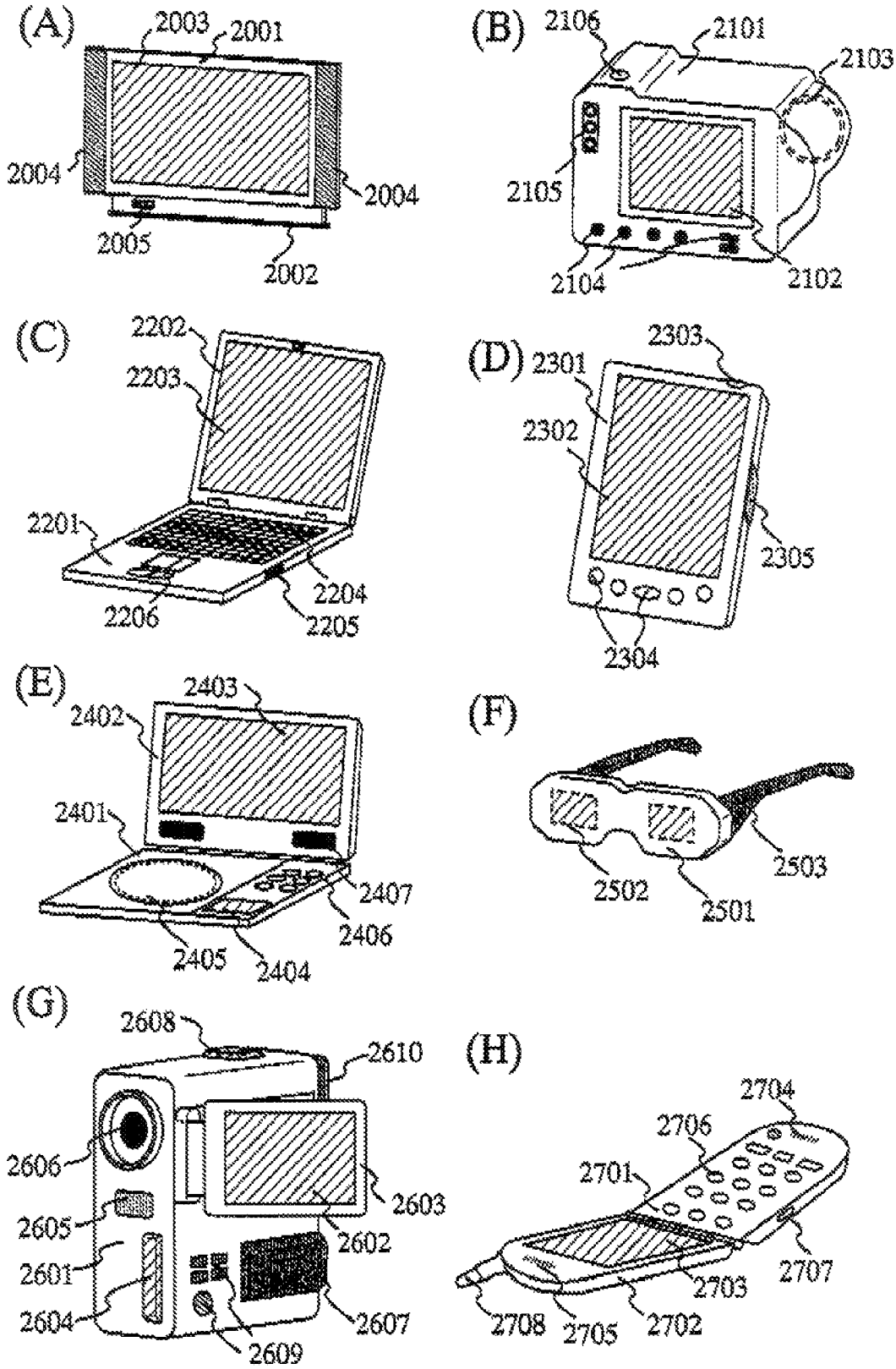
FIG. 6 Views showing examples of electronic apparatuses of the invention.
Figure 7:
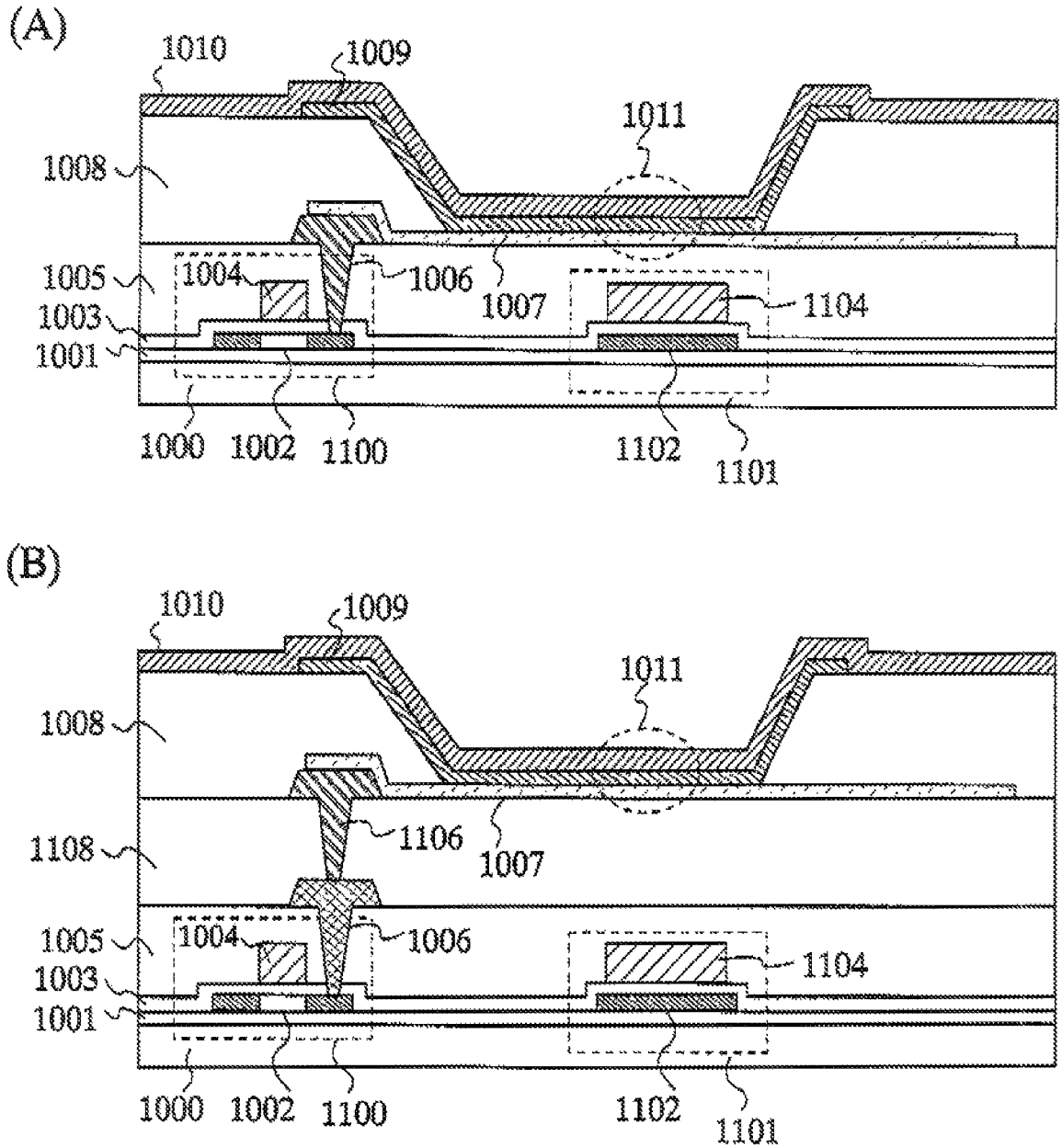
FIG. 7 Views showing Embodiment 2 of the invention.
Figure 8:
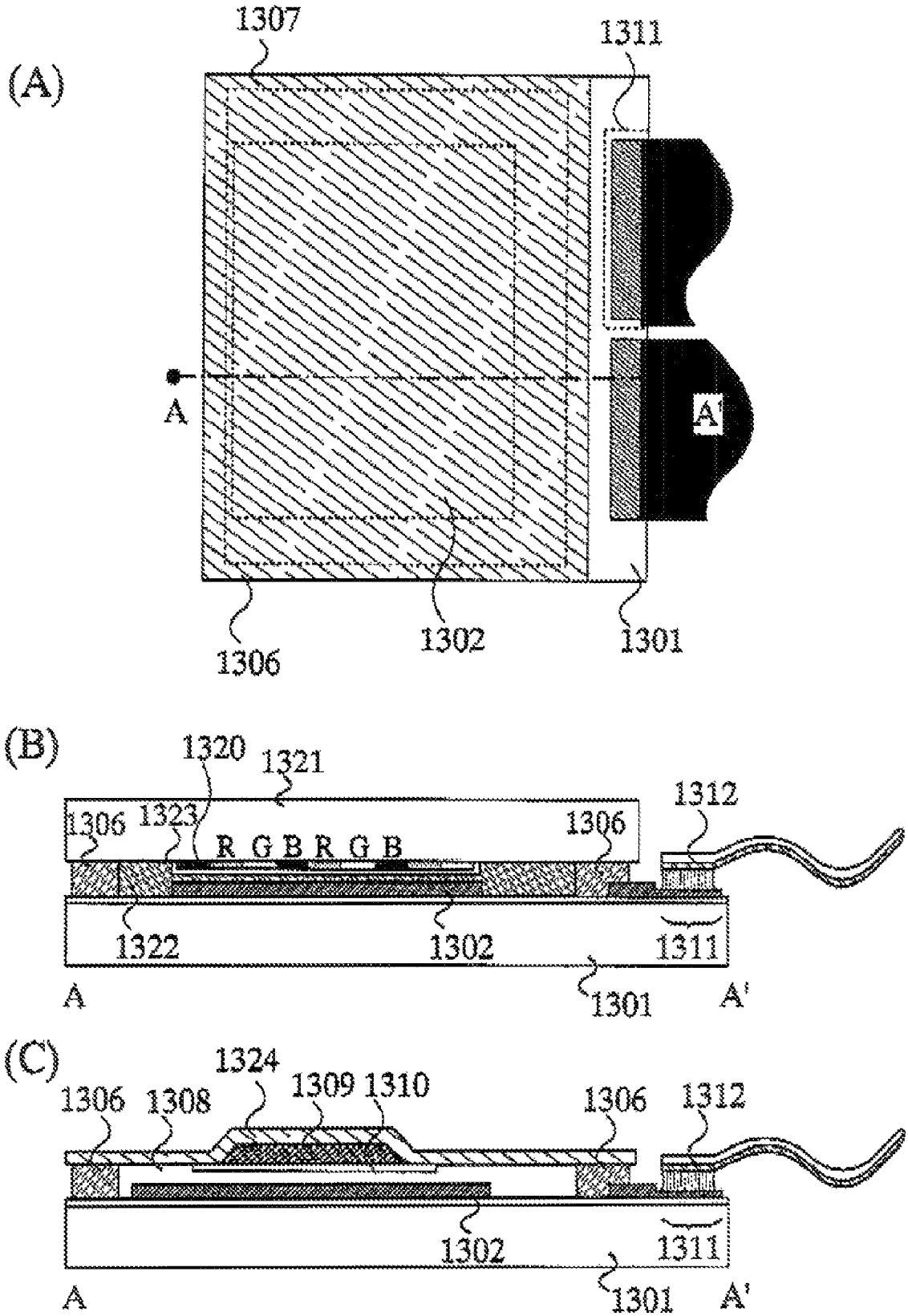
FIG. 8 Views showing Embodiment 3 of the invention.
Figure 9:
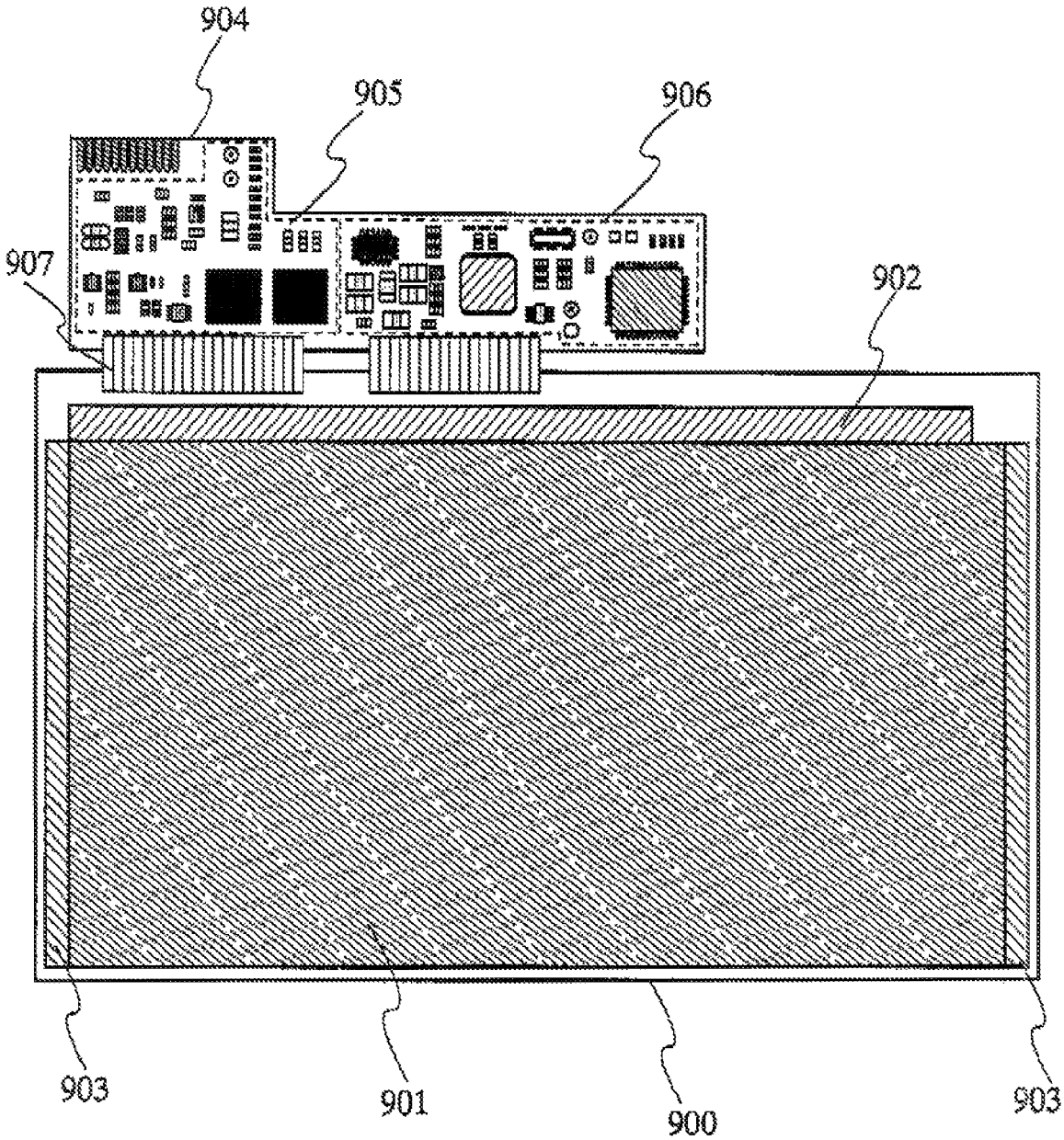
FIG. 9 A view showing Embodiment 4 of the invention.

The invention claimed is:

1. A display device comprising a first wire, a second wire, a third wire, a fourth wire, a fifth wire, and a plurality of pixels, wherein each of the plurality of pixels comprises a first switching element, a second switching element, a third switching element, a first capacitor having a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one electrode of the light emitting element and to the third wire through the first switching element and the second switching element;

wherein an electrode which controls an ON state or an OFF state of the second switching element is electrically connected to one electrode of the second capacitor and to the fourth wire through the third switching element;

wherein an ON state or an OFF state of the first switching element is controlled by a signal inputted to the second wire; and wherein an ON state or an OFF state of the third switching element is controlled by a signal inputted to the fifth wire.

2. The display device according to claim 1, wherein the first capacitor holds a voltage between the pair of electrodes of the first capacitor, and the second capacitor holds a voltage between the pair of electrodes of the second capacitor.

3. The display device according to claim 1, wherein each of the first wire and the second wire is electrically connected to a respective external circuit.

4. A display device comprising a first wire, a second wire, a third wire, a fourth wire, a fifth wire, and a plurality of pixels, wherein each of the plurality of pixels comprises a first transistor, a second transistor, a third transistor, a first capacitor having a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one of a source or drain of the first transistor and one electrode of the light emitting element;

wherein the other of the source or the drain of the first transistor is electrically connected to one of a source or drain of the second transistor;

wherein a gate of the first transistor is electrically connected to the second wire;

wherein the other of the source or the drain of the second transistor is electrically connected to the third wire;

wherein a gate of the second transistor is electrically connected to one of a source or drain of the third transistor and one electrode of the second capacitor;

wherein the other of the source or the drain of the third transistor is electrically connected to the fourth wire; and wherein a gate of the third transistor is electrically connected to the fifth wire.

5. The display device according to claim 4, wherein the first capacitor holds a voltage between the pair of electrodes of the first capacitor, and the second capacitor holds a voltage between the pair of electrodes of the second capacitor.

6. The display device according to claim 4, wherein each of the first wire and the second wire is electrically connected to a respective external circuit.

7. A display module including a display device comprising a first wire, a second wire, a third wire, a fourth wire, a fifth wire, and a plurality of pixels, wherein each of the plurality of pixels comprises a first switching element, a second switching element, a third switching element, a first capacitor having a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one electrode of the light emitting element and to the third wire through the first switching element and the second switching element;

wherein an electrode which controls an ON state or an OFF state of the second switching element is electrically connected to one electrode of the second capacitor and to the fourth wire through the third switching element;

wherein an ON state or an OFF state of the first switching element is controlled by a signal inputted to the second wire; and wherein an ON state or an OFF state of the third switching element is controlled by a signal inputted to the fifth wire.

8. The display module including a display device according to claim 7, wherein the first capacitor holds a voltage between the pair of electrodes of the first capacitor, and the second capacitor holds a voltage between the pair of electrodes of the second capacitor.

9. The display module including a display device according to claim 7, wherein each of the first wire and the second wire is electrically connected to a respective external circuit.

10. A display module including a display device comprising a first wire, a second wire, a third wire, a fourth wire, a fifth wire, and a plurality of pixels, wherein each of the plurality of pixels comprises a first transistor, a second transistor, a third transistor, a first capacitor having a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one of a source or drain of the first transistor and one electrode of the light emitting element;

wherein the other of the source or the drain of the first transistor is electrically connected to one of a source or drain of the second transistor;

wherein a gate of the first transistor is electrically connected to the second wire;

wherein the other of the source or the drain of the second transistor is electrically connected to the third wire;

wherein a gate of the second transistor is electrically connected to one of a source or drain of the third transistor and one electrode of the second capacitor;

wherein the other of the source or the drain of the third transistor is electrically connected to the fourth wire; and wherein a gate of the third transistor is electrically connected to the fifth wire.

11. The display module including a display device according to claim 10, wherein the first capacitor holds a voltage between the pair of electrodes of the first capacitor, and the second capacitor holds a voltage between the pair of electrodes of the second capacitor.

12. The display module including a display device according to claim 10, wherein each of the first wire and the second wire is electrically connected to a respective external circuit.

13. A portable information terminal having a display portion a first wire, a second wire, a third wire, a fourth wire, a fifth wire, and a plurality of pixels, wherein each of the plurality of pixels comprises a first switching element, a second switching element, a third switching element, a first capacitor which holds a voltage between a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one electrode of the light emitting element and to the third wire through the first switching element and the second switching element;

wherein an electrode which controls an ON state or an OFF state of the second switching element is electrically connected to one electrode of the second capacitor and to the fourth wire through the third switching element;

wherein an ON state or an OFF state of the first switching element is controlled by a signal inputted to the second wire; and wherein an ON state or an OFF state of the third switching element is controlled by a signal inputted to the fifth wire.

14. The portable information terminal according to claim 13, wherein the first capacitor holds a voltage between the pair of electrodes of the first capacitor, and the second capacitor holds a voltage between the pair of electrodes of the second capacitor.

15. The portable information terminal according to claim 13, wherein each of the first wire and the second wire is electrically connected to a respective external circuit.

16. A portable information terminal having a display portion comprising a first wire, a second wire, a third wire, a fourth wire, a fifth wire, and a plurality of pixels, wherein each of the plurality of pixels comprises a first transistor, a second transistor, a third transistor, a first capacitor having a pair of electrodes, a second capacitor having a pair of electrodes, and a light emitting element having a pair of electrodes;

wherein one electrode of the first capacitor is electrically connected to the first wire;

wherein the other electrode of the first capacitor is electrically connected to one of a source or drain of the first transistor and one electrode of the light emitting element;

wherein the other of the source or the drain of the first transistor is electrically connected to one of a source or drain of the second transistor;

wherein a gate of the first transistor is electrically connected to the second wire;

wherein the other of the source or the drain of the second transistor is electrically connected to the third wire;

wherein a gate of the second transistor is electrically connected to one of a source or drain of the third transistor and one electrode of the second capacitor;

wherein the other of the source or the drain of the third transistor is electrically connected to the fourth wire; and wherein a gate of the third transistor is electrically connected to the fifth wire.

17. The portable information terminal according to claim 16, wherein the first capacitor holds a voltage between the pair of electrodes of the first capacitor, and the second capacitor holds a voltage between the pair of electrodes of the second capacitor.

18. The portable information terminal according to claim 16, wherein each of the first wire and the second wire is electrically connected to a respective external circuit.

* * * * *

UNITED STATES PATENT AND TRADEMARK OFFICE

CERTIFICATE OF CORRECTION

PATENT NO. : 7,830,340 B2
APPLICATION NO. : 11/287472
DATED : November 9, 2010
INVENTOR(S) : Atsushi Umezaki It is certified that error appears in the above-identified patent and that said Letters Patent is hereby corrected as shown below:

Column 2, line 34, replace “Fore” with --For--;

Column 3, line 59, replace “a” with --an--;

Column 4, line 45, replace “a” with --an--;

Column 5, line 22, replace “am” with --an--;

Column 7, line 25, replace “a” with --an--;

Column 10, line 5, replace “According” with --Accordingly--;

Column 11, line 41, replace “shown” with --shows--;

Column 13, line 50, replace “element” with --elements--;

Column 13, line 55, replace “material” with --materials--;

Column 14, line 28, replace “correspond” with --corresponds--;

Column 15, line 1, replace “structure” with --substrate--;

Column 15, line 32, replace “along” with --long--.

Signed and Sealed this
Thirty-first Day of July, 2012

David J. Kappos

David J. Kappos
*Director of the United States Patent and Trademark Office*